United States Patent [19]

Rogers et al.

[11] 3,955,230

[45] May 11, 1976

[54] RECREATIONAL BUOYANCY DEVICE

[76] Inventors: Campbell Clifford Rogers, 865 Elsmore Road; William Joseph Taylor, 355 Vinmore St., both of Richmond, British Columbia, Canada

[22] Filed: Feb. 10, 1975

[21] Appl. No.: 548,832

[52] U.S. Cl. ..... 9/347; 9/5

[51] Int. Cl.[2] ..... B63C 9/08

[58] Field of Search ..... 9/5, 301, 311, 329, 9/336, 337, 340, 347

[56] References Cited

UNITED STATES PATENTS

| | | | |
|---|---|---|---|
| 1,824,711 | 9/1931 | De Noya | 9/5 |
| 2,327,169 | 8/1943 | Bucknell | 9/5 |
| 2,674,753 | 4/1954 | Wood | 9/5 |
| 2,894,270 | 7/1959 | Manthos | 9/5 |
| 2,998,613 | 9/1961 | Lynn et al. | 9/347 |

*Primary Examiner*—Trygve M. Blix
*Assistant Examiner*—Stuart M. Goldstein
*Attorney, Agent, or Firm*—W. Charles Kent

[57] ABSTRACT

A portable, recreational, buoyancy device comprising an integral rigid, ring-like floating unit having a central opening designed to accommodate the user's body, straps supporting the user in said opening, shoulder straps associated with the unit to suspend the unit from the shoulders of the user when in the opening, and oars mounted on the unit. This versatile device safely buoys and propels the user when floating in the water. When suspended from the user's shoulders, the upper surface of the rigid unit may provide a handy, readily accessible shelf for storage of equipment. The device at the same time provides much greater personal mobility for the user in water areas.

9 Claims, 2 Drawing Figures

RECREATIONAL BUOYANCY DEVICE

BACKGROUND OF THE INVENTION

This invention relates generally to a recreational device to be used by a person as an aid to convenience, safety and mobility in and around water. More particularly, the invention relates to a portable buoyancy device which is suspended from the user's shoulders about his waist when out of the water and supports and transports him when in the water.

There are many known recreational or safety devices for water in the middle of which a person is secured or sits. For example, U.S. Pat. Nos. 2,959,796 of De Sander et al., 2,674,753 of Wood, 2,894,270 of Manthos and 3,324,488 of Schultz describe generally circular floats which encircle individuals in the water. The floats described in these patents also show seating arrangements whereby the individual is supported in the water. The De Sander, Wood and Manthos devices however have inflatable components which carry with them the consequent problem of upkeep and danger of untimely collapse. Any of these devices which disclose mechanical propulsion means connected thereto, such as the Manthos and Schultz devices, are heavy or extremely cumbersome and clearly not intended to be suspended from the shoulders of a person within while not floating in water.

All of these devices lack the versatility of applicants' invention hereinafter described.

SUMMARY OF THE INVENTION

According to the present invention, a recreational device for use in or around water is provided comprising an integral, rigid, ring-like floating unit having a central opening designed to accommodate the user's body. Means are provided to support the user in said opening and to suspend the unit from the shoulders of the user when in said opening. Propelling means such as oars are mounted on the unit and suspension means may comprise straps which act as a harness into which a person slips so that, while walking, the device is suspended from the person's shoulders about the waist, while in the water the device buoys the person up, the support ensuring that the person is safely secured in the device at all times.

The versatility of the device according to the present invention, whether it is used in the course of hunting or fishing, or whether it is used as an amusement device at a beach or pool, can be readily appreciated. For example, a hunter or fisherman, standing by a river's edge, can easily and not uncomfortably "wear" the device about his waist, the rigid unit being suspended from his shoulders by the shoulder straps. The upper surface of the unit may provide a generally horizontal "shelf" for holding fishing tackle, food, cigarettes or any other personal equipment, so that such items are immediately and readily available to the user at all times. Should he wish to move to a different location in or along the body of water, assuming he is appropriately attired with hip waders or the like, he can simply move into the water and maneuver about, completely unrestricted in such movement, using the oars. He can position himself for fishing in the body of water at a place which may be over his head. Or the device may be used by him simply to cross a deep river or stream. The rugged, lightweight construction of the device lends itself to such uses.

Alternatively, the device is ideally suited for recreation and amusement at beaches or pools. Non-swimmers can be safely strapped into the device and may safely and quickly propel themselves through the water in the device. Parents of non-swimming children need be less concerned about the safety of their child when he is secured in such a device and is floating in the water in it.

Of course, a smaller size of unit may be constructed especially suited for children.

BRIEF DESCRIPTION OF THE DRAWINGS

Other objects and advantages of the invention will become apparent upon reading the following detailed description and upon referring to the drawings in which.

Similar features in the drawings have been given similar reference numerals.

While the invention will be described in connection with the example embodiment illustrated, it will be understood that it is not intended to limit the invention to that embodiment. On the contrary it is intended to cover all alternatives, modifications and equivalents as may be included within the spirit and scope of the invention as defined by the appended claims.

DETAILED DESCRIPTION OF THE INVENTION

Figure 1:
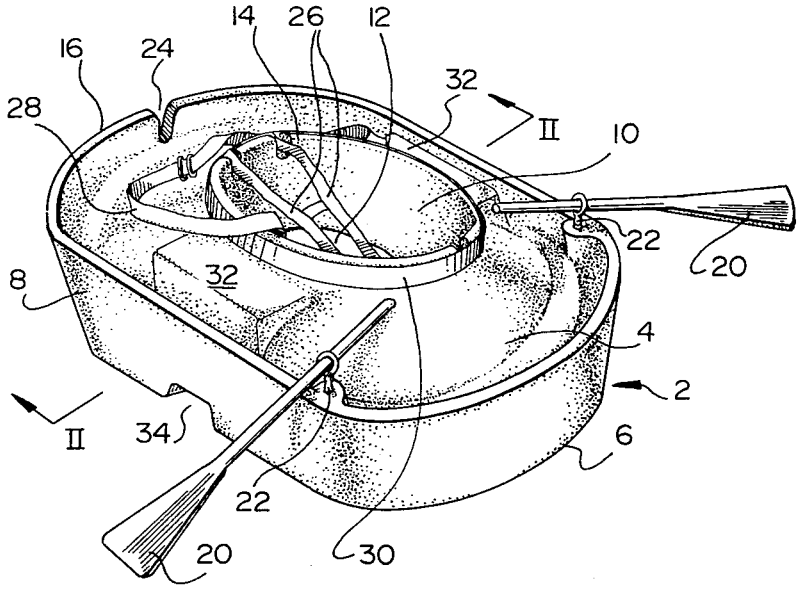
FIG. 1 is a perspective view of an example embodiment of a recreational device according to the present invention.
Figure 2:
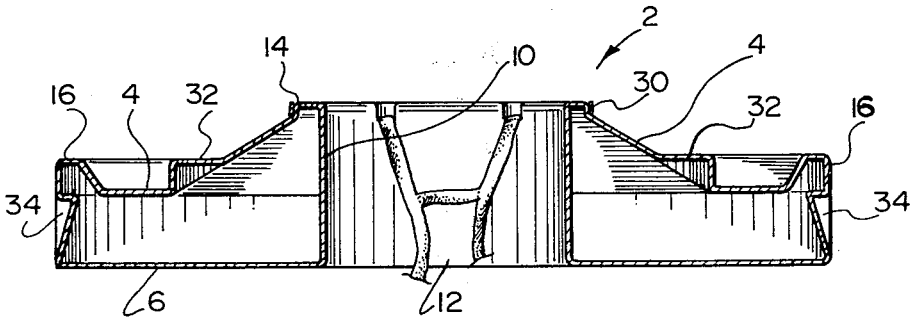
FIG. 2 is a sectional view of the device shown in FIG. 1 taken along line II—II.

Turning to FIG. 1, a recreational device according to the present invention is illustrated having integral rigid ring-like floating body or unit 2 with upper surface 4 and lower surface 6 (shown in FIG. 2). Side 8 extends between the upper and lower surfaces about their periphery while inner side 10 defines central opening 12 passing through the unit from the upper surface to the lower surface. Sides 8 and 10 ensure that unit 2 is completely enclosed. The unit may be hollow or filled with an appropriate buoyant material. Opening 12 is of sufficient diameter to permit encircling a person's hips or waist.

The upper surface is made up of elevated inner rim 14 and outer rim 16. Outer rim 16 conforms to the general circumferential shape of the side of the unit. A generally frusto-conical central surface extends in decreasing elevation between the outer lower edge of inner rim 14 and the inner lower edge of outer rim 16. Oars 20 are secured to the unit by means of oar locks 22 which are pivotally secured along the top of rim 16 on opposite sides towards the front of unit 2. At the rear thereof, interruption 24 in rim 16 ensures that water which may spill onto upper surface 4 can readily flow therefrom off of rigid unit 2. Crotch straps 26 are secured between opposite portions of inner sides 10 across opening 12, while shoulder straps 28 are secured to rigid unit 2 beside opening 12. A strap 30 secured about the outer portion of rim 14 anchors crotch straps 26 and shoulder straps 28 to the rigid unit.

Arm rests 32 integral with upper surface 4 on either side of opening 12 may be provided. In addition, indentations 34 at the lower edge of sides 8 on opposite sides of the device may be provided to assist handling thereof.

While the shape thereof as illustrated is a preferred shape in view of its aesthetic and functional desirability, it is understood that rigid unit 2 may be formed in any suitable ring-like shape.

Thus it is apparent that there has been provided, in accordance with the invention, a recreational water device that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly it is intended to embrace all such alternatives, modifications and variations as fall within the spirit and broad scope of the appended claims.

What is claimed as new is:

1. A portable, recreational, buoyancy device comprising an integral, rigid, ring-like floating unit having a central opening designed to accommodate the user's body, wherein said unit is of generally elongated shape, and has a flat bottom surface and an upper surface comprising elevated inner and outer rims, said outer rim circumscribing the periphery of said surface and said inner rim circumscribing said opening, and a generally frusto-conical central surface extending from the outer lower edge of said inner rim to the inner lower edge of said outer rim, means to support the user in said opening, means to suspend the unit from the shoulders of the user when in said opening and propelling means mounted on said unit.

2. A device according to claim 1 wherein said unit is hollow.

3. A device according to claim 1 wherein said central opening is of circular cross-section.

4. A device according to claim 1 wherein said outer rim is interrupted by an opening therethrough, said opening permitting water which might accumulate in the depression between said inner and outer rims to spill off of said upper surface.

5. A device according to claim 1 wherein crotch straps secured to the unit extend across said opening to support the user.

6. A device according to claim 1 wherein shoulder straps are secured to the unit for suspending the unit from the shoulders of the user.

7. A device according to claim 1 wherein crotch straps across the opening for supporting the user and shoulder straps for suspending the unit from the shoulders of the user are secured to a strap circumscribing and secured to the periphery of said inner rim.

8. A device according to claim 1 wherein oars are pivotally connected to opposite sides of the unit.

9. A device according to claim 8 wherein said oars pivot about points located on opposite sides on said outer rim.

* * * * *